US006866371B2

(12) United States Patent
Sadasivan et al.

(10) Patent No.: US 6,866,371 B2
(45) Date of Patent: Mar. 15, 2005

(54) METHOD AND APPARATUS FOR PRINTING AND COATING

(75) Inventors: Sridhar Sadasivan, Rochester, NY (US); David J. Nelson, Rochester, NY (US); Seshadri Jagannathan, Pittsford, NY (US); Ramesh Jagannathan, Rochester, NY (US); Suresh Sunderrajan, Rochester, NY (US); Glen C. Irvin, Jr., Rochester, NY (US); Gary E. Merz, Rochester, NY (US); John E. Rueping, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 393 days.

(21) Appl. No.: 10/051,888

(22) Filed: Jan. 17, 2002

(65) Prior Publication Data

US 2003/0132993 A1 Jul. 17, 2003

(51) Int. Cl.[7] ..... B41J 2/175
(52) U.S. Cl. ..... 347/85
(58) Field of Search ..... 347/84, 85, 89, 347/91, 54–56, 44, 17, 20, 21, 95, 100, 101, 105; 428/195; 264/12, 13, 15

(56) References Cited

U.S. PATENT DOCUMENTS 3,457,949 A * 7/1969 Coulter ..... 137/543.21
4,734,227 A 3/1988 Smith
5,009,367 A 4/1991 Nielsen
5,461,401 A * 10/1995 Shrivastava et al. ..... 346/54
5,573,682 A 11/1996 Beason, Jr. et al.
5,639,441 A * 6/1997 Sievers et al. ..... 424/9.3
6,116,718 A 9/2000 Peeters et al.
6,228,311 B1 * 5/2001 Temple et al. ..... 264/400
6,348,561 B1 * 2/2002 Mychajlowskij et al. ... 528/288
6,471,327 B2 * 10/2002 Jagannathan et al. ..... 347/21

FOREIGN PATENT DOCUMENTS

| | | |
|---|---|---|
| EP | 0317219 | 5/1989 |
| EP | 0671268 | 9/1995 |
| EP | 0997298 | 5/2000 |
| EP | 1236519 | 9/2002 |

* cited by examiner

*Primary Examiner*—Stephen D. Meier
*Assistant Examiner*—An H. Do
(74) *Attorney, Agent, or Firm*—William R. Zimmerli

(57) ABSTRACT

A method and apparatus for printing and coating includes providing a pressurized source of a thermodynamically stable mixture of a solvent and a marking material. A printhead is connected to the pressurized source. The printhead is configured to produce a first shaped beam of the marking material and a second shaped beam of the marking material. The marking material can be different marking materials or the same marking material.

34 Claims, 15 Drawing Sheets

METHOD AND APPARATUS FOR PRINTING AND COATING

CROSS REFERENCE TO RELATED APPLICATIONS

Reference is made to pending U.S. Ser. No. 09/794,671, entitled, Apparatus and Method of Delivering A Focused Beam of a Thermodynamically Stable/Metastable Mixture of a Functional Material In A Dense Fluid onto A Receiver filed in the name of Ramesh Jagannathan et al., on Feb. 27, 2001; and U.S. Ser. No. 09/903,883, entitled Method and Apparatus For Controlling Depth of A Solvent Free Functional Material, filed in the name of Ramesh Jagannathan et al. on Jul. 12, 2001.

FIELD OF THE INVENTION

This invention relates generally to printing and more particularly, to printing using solvent free materials.

BACKGROUND OF THE INVENTION

Traditionally, digitally controlled printing capability is accomplished by one of two technologies. The first technology, commonly referred to as "continuous stream" or "continuous" ink jet printing, uses a pressurized ink source which produces a continuous stream of ink droplets (typically containing a dye or a mixture of dyes). Conventional continuous ink jet printers utilize electrostatic charging devices that are placed close to the point where a filament of working fluid breaks into individual ink droplets. The ink droplets are electrically charged and then directed to an appropriate location by deflection electrodes having a large potential difference. When no print is desired, the ink droplets are deflected into an ink capturing mechanism (catcher, interceptor, gutter, etc.) and either recycled or disposed of. When print is desired, the ink droplets are not deflected and allowed to strike a print media. Alternatively, deflected ink droplets may be allowed to strike the print media, while non-deflected ink droplets are collected in the ink capturing mechanism.

The second technology, commonly referred to as "drop-on-demand" ink jet printing, provides ink droplets (typically including a dye or a mixture of dyes) for impact upon a recording surface using a pressurization actuator (thermal, piezoelectric, etc.). Selective activation of the actuator causes the formation and ejection of a flying ink droplet that crosses the space between the printhead and the print media and strikes the print media. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle, thus helping to keep the nozzle clean.

Conventional "drop-on-demand" ink jet printers utilize a pressurization actuator to produce the ink jet droplet at orifices of a print head. Typically, one of two types of actuators are used including heat actuators and piezoelectric actuators. With heat actuators, a heater, placed at a convenient location, heats the ink causing a quantity of ink to phase change into a gaseous steam bubble that raises the internal ink pressure sufficiently for an ink droplet to be expelled. With piezoelectric actuators, an electric field is applied to a piezoelectric material possessing properties that create a mechanical stress in the material causing an ink droplet to be expelled. The most commonly produced piezoelectric materials are ceramics, such as lead zirconate titanate, barium titanate, lead titanate, and lead metaniobate.

Conventional ink jet printers are disadvantaged in several ways. For example, in order to achieve very high quality images having resolutions approaching 900 dots per inch while maintaining acceptable printing speeds, large numbers of discharge devices located on a printhead need to be frequently actuated. The frequency of actuation limits the viscosity range of the ink used in these printers. Typically, the viscosity of the ink is lowered by adding solvents such as water, etc. The presence of solvents can cause an increase in ink bleeding during drying which reduces image sharpness negatively affecting image resolution and other image quality metrics. Additionally, the presence of solvents results in slower ink drying times after the ink has been deposited on the receiver which decreases overall productivity.

Conventional ink jet printers are also disadvantaged in that the discharge devices of the printheads can become partially blocked and/or completely blocked with ink. In order to reduce this problem, solvents, such as glycol, glycerol, etc., are added to the ink formulation, which can adversely affect image quality due to an increase in ink bleeding during the time the ink is drying.

In conventional ink jet printing, when an overcoat is desired, the ink is allowed to dry prior to applying the overcoat. Again, the presence of solvents results in slower ink drying times after the ink has been deposited on the receiver. Therefore, overall printing system productivity is reduced due to the waiting period associated with increased drying times.

When a precoat, typically containing solvents, is desired, the precoat is usually allowed to dry prior to the commencing the printing process. Allowing the precoat to dry reduces the likelihood of ink bleeding when the ink is applied to the receiver. The time associated with drying reduces the overall printing system productivity.

Other technologies that deposit a dye onto a receiver using gaseous propellants are known. For example, Peeters et al., in U.S. Pat. No. 6,116,718, issued Sep. 12, 2000, discloses a print head for use in a marking apparatus in which a propellant gas is passed through a channel, the marking material is introduced controllably into the propellant stream to form a ballistic aerosol for propelling non-colloidal, solid or semi-solid particulate or a liquid, toward a receiver with sufficient kinetic energy to fuse the marking material to the receiver. There is a problem with this technology in that the marking material and propellant stream are two different entities and the propellant is used to impart kinetic energy to the marking material. When the marking material is added into the propellant stream in the channel, a non-colloidal ballistic aerosol is formed prior to exiting the print head. This non-colloidal ballistic aerosol, which is a combination of the marking material and the propellant, is not thermodynamically stable/metastable. As such, the marking material is prone to settling in the propellant stream which, in turn, can cause marking material agglomeration, leading to nozzle obstruction and poor control over marking material deposition.

Technologies that use supercritical fluid solvents to create thin films are also known. For example, R. D. Smith in U.S. Pat. No. 4,734,227, issued Mar. 29, 1988, discloses a method of depositing solid films or creating fine powders through the dissolution of a solid material into a supercritical fluid solution and then rapidly expanding the solution to create particles of the marking material in the form of fine powders or long thin fibers, which may be used to make films. There is a problem with this method in that the free-jet expansion of the supercritical fluid solution results in a non-collimated/defocused spray that cannot be used to create high resolution patterns on a receiver. Further, defocusing leads to losses of the marking material.

As such, there is a need for a technology that permits high speed, accurate, and precise delivery of solvent free marking materials to a receiver to create high resolution images. There is also a need for a technology that permits high speed, accurate, and precise imaging on a receiver having reduced material agglomeration characteristics.

SUMMARY OF THE INVENTION

According to one feature of the present invention, a printhead for delivering solvent free materials to a receiver includes a first discharge device having an inlet and an outlet. A portion of the first discharge device defines a first delivery path, and a portion of the first discharge device is adapted to be connected to a pressurized source of a thermodynamically stable mixture of a fluid and a first marking material at the inlet. The first discharge device is configured to produce a shaped beam of the first marking material with the fluid being in a gaseous state at a location beyond the outlet of the first discharge device. A first actuating mechanism is positioned along the first delivery path. The first actuating mechanism has a first position removed from the first delivery path and a second position in the first delivery path. A second discharge device has an inlet and an outlet. A portion of the second discharge device defining a second delivery path with a portion of the second discharge device being adapted to be connected to a pressurized source of a thermodynamically stable mixture of a fluid and a second marking material at the inlet. The second discharge device is configured to produce a diverging beam of the second marking material with the fluid being in a gaseous state at a location beyond the outlet of the second discharge device.

According to another feature of the present invention, a method of printing includes providing a pressurized source of a thermodynamically stable mixture of a solvent and a marking material; providing a discharge device having an inlet and an outlet, a portion of the discharge device defining a delivery path, a portion of the discharge device being adapted to be connected to a pressurized source of a thermodynamically stable mixture of a fluid and a marking material at the inlet; causing the discharge device to produce a first shaped beam of the marking material, the fluid being in a gaseous state at a location beyond the outlet of the discharge device; and causing the discharge device to produce a second shaped beam of the marking material, the fluid being in a gaseous state at a location beyond the outlet of the discharge device.

According to another feature of the present invention, a printing apparatus includes a pressurized source of a thermodynamically stable mixture of a fluid and a marking material. A portion of the printhead defines a delivery path with the delivery path of the printhead being connected to the pressurized source. The printhead includes a discharge device. The discharge device has an outlet with a portion of the discharge device being positioned along the delivery path. The discharge device is shaped to produce a shaped beam of the marking material with the fluid being in a gaseous state at a location beyond the outlet of the discharge device. An actuating mechanism is positioned along the delivery path and has an open position at least partially removed from the delivery path. A receiver retaining device is moveably positioned at a predetermined distance from the outlet of the discharge device.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
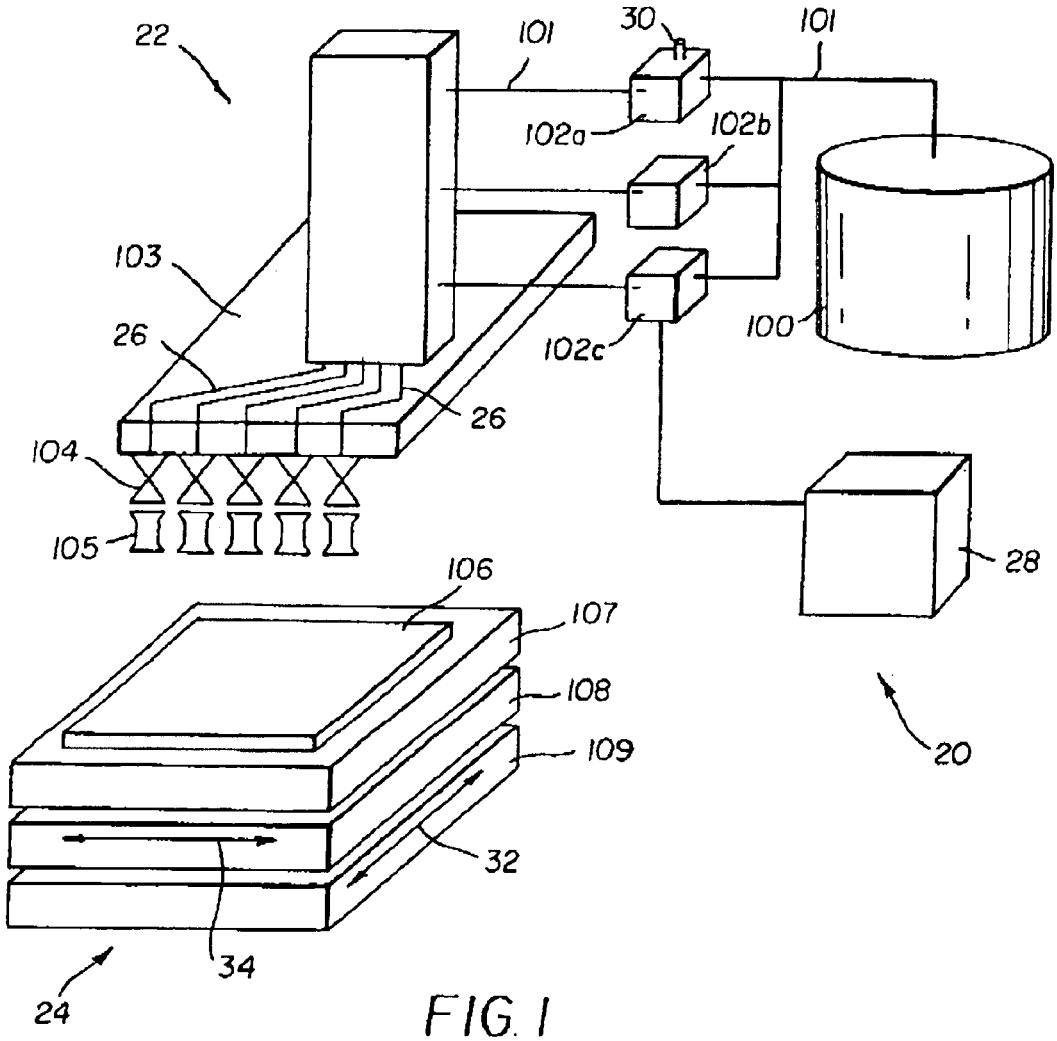
FIG. 1 is a schematic view of a first embodiment made in accordance with the present invention.

The present description will be directed in particular to elements forming part of, or cooperating more directly with, apparatus in accordance with the present invention. It is to be understood that elements not specifically shown or described may take various forms well known to those skilled in the art. Additionally, materials identified as suitable for various facets of the invention, for example, marking materials, solvents, equipment, etc. are to be treated as exemplary, and are not intended to limit the scope of the invention in any manner.

Referring to FIGS. 1–6, a printing apparatus 20 is shown. The printing apparatus 20 includes a marking material delivery system 22 and a receiver retaining device 24. The marking material delivery system has a pressurized source of a thermodynamically stable mixture of a fluid and a marking material, herein after referred to as a formulation reservoir(s) 102*a*, 102*b*, 102*c*, connected in fluid communication to a delivery path 26 at least partially formed in/on a printhead 103. The printhead 103 includes a discharge device 105 positioned along the delivery path 26 configured (as discussed below) to produce a shaped beam of the marking material. An actuating mechanism 104 is also positioned along the delivery path 26 and is operable to control delivery of the marking material though the printhead 103.

The formulation reservoir(s) 102*a*, 102*b*, 102*c* is connected in fluid communication to a source of fluid 100 and a source of marking material 28 (shown with reference to formulation reservoir 102*c* in FIG. 1). Alternatively, the marking material can be added to the formulation reservoir (s) 102*a*, 102*b*, 102*c* through a port 30 (shown with reference to formulation reservoir 102*a* in FIG. 1).

One formulation reservoir 102*a*, 102*b*, or 102*c* can be used when single color printing is desired. Alternatively, multiple formulation reservoirs 102*a*, 102*b*, or 102*c*can be used when multiple color printing is desired. When multiple formulation reservoirs 102*a*, 102*b*, 102*c* are used, each formulation reservoir 102*a*, 102*b*, 102*c* is connected in fluid communication through delivery path 26 to a dedicated discharge device(s) 105. One example of this includes dedicating a first row of discharge devices 105 to formulation reservoir 102*a*; a second row of discharge devices 105 to formulation reservoir 102*b*; and a third row of discharge devices to formulation reservoir 102*c*. Other formulation reservoir discharge device combinations exist depending on the particular printing application.

A discussion of illustrative embodiments follows with like components being described using like reference symbols.

Referring to FIG. 1, a first embodiment is shown. The printhead 103 which includes at least one discharge device 105 and at least one actuating mechanism 104 remains stationary during operation. However, the printhead 103 can maintain a limited movement capability as is required to dither the image (typically from one to two pixels in length). A receiver 106 positioned on a receiver holder 107 moves in a first direction 32 and a second direction 34. Typically, the second direction 34 is substantially perpendicular to the first direction 32. The two directional motion of receiver 106 can be achieved by using a receiver retaining device 24 having a first motorized translation stage 108 positioned over a second motorized translation stage 109.

In this embodiment, the printhead 103 can be connected to the formulation reservoir(s) 102*a*, 102*b*, 102*c* using essentially rigid, inflexible tubing 101. As the marking material delivery system is typically under high pressure from the supercritical fluid source 100, through tubing 101 and the formulation reservoirs 102*a*, 102*b*, 102*c*, to the actuating mechanism 104, the tubing 101 can have an increased wall thickness which helps to maintain a constant pressure through out the marking material delivery system 22.

Figure 2:
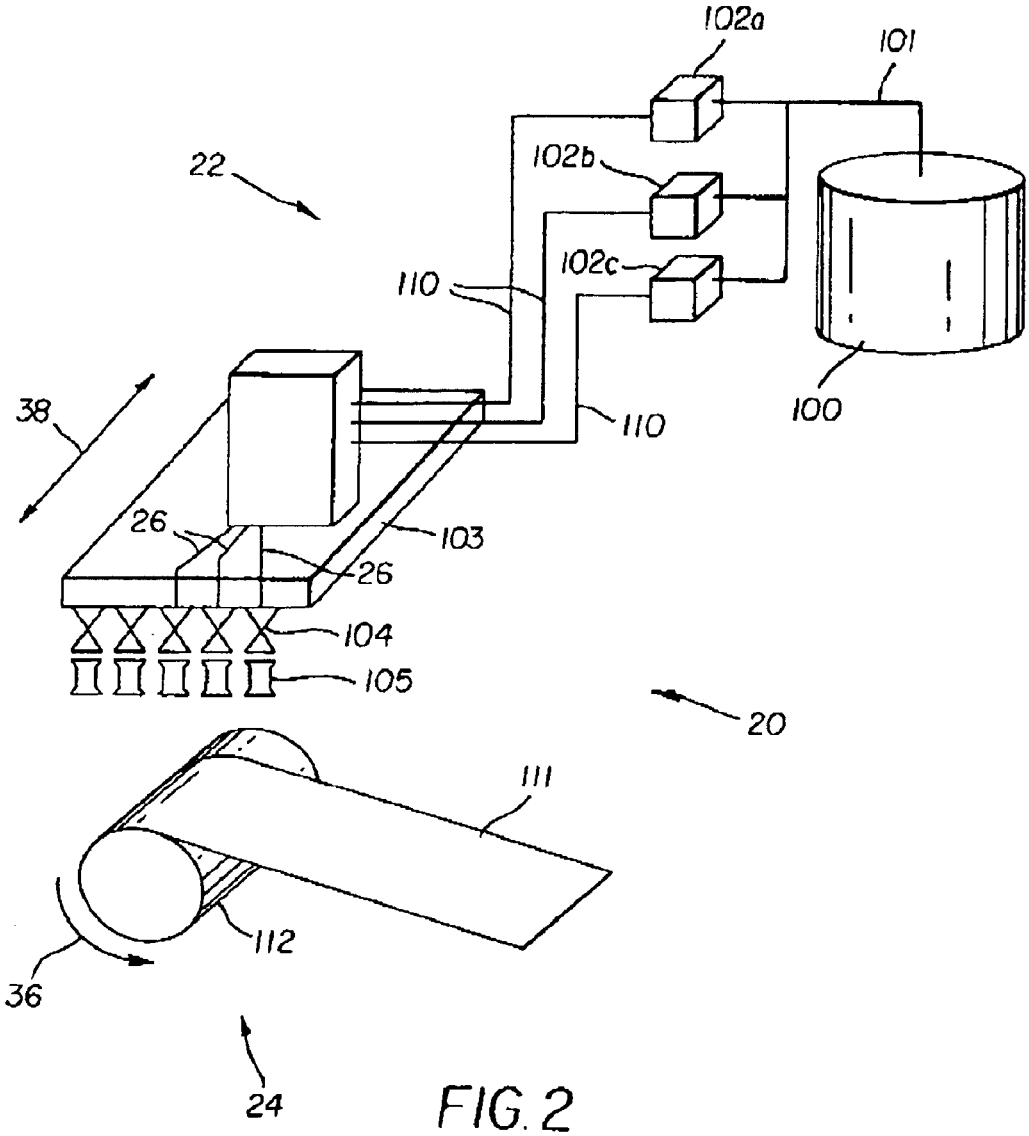
FIGS. 2–5 are schematic views of alternative embodiments made in accordance with the present invention.

Referring to FIG. 2, a second embodiment is shown. In this embodiment the receiver retaining device 24 is a roller 112 that provides one direction of motion 36 for a receiver 11 while the printhead 103 translates in a second direction 38. Rigid tubing 101 connects the supercritical fluid source 100 to the formulation reservoir(s) 102*a*, 102*b*, 102*c*. However, the printhead 103 is connected to the formulation reservoir(s) 102*a*, 102*b*, 102*c* by a flexible high pressure tube(s) 110. A suitable flexible hose can be, for example, a Titeflex extra high pressure hose P/N R157-3 (0.110 inside diameter, 4000 psi rated with a 2 in bend radius) commercially available from Kord Industrial, Wixom, Mich. The supercritical fluid source 100 is remotely positioned relative to the printhead 103.

In a multiple color printing operation, for example Cyan, Magenta, and Yellow color printing, each color is applied in a controlled manner through the actuating mechanisms 104 and discharge devices 105 of printhead 103 as the printhead 103 translates in second direction 38. The printhead 103 has at least one discharge device 103 dedicated to each predetermined color. Then, the roller 112 increments the flexible receiver 111 in the first direction 36 by a small amount. The printhead 103 then translates back along second direction 38 printing the next line. For adequate printhead position accuracy, the printing apparatus 20 typically includes a feedback signal, often created, for example, by a linear optical encoder (not shown).

Figure 3:
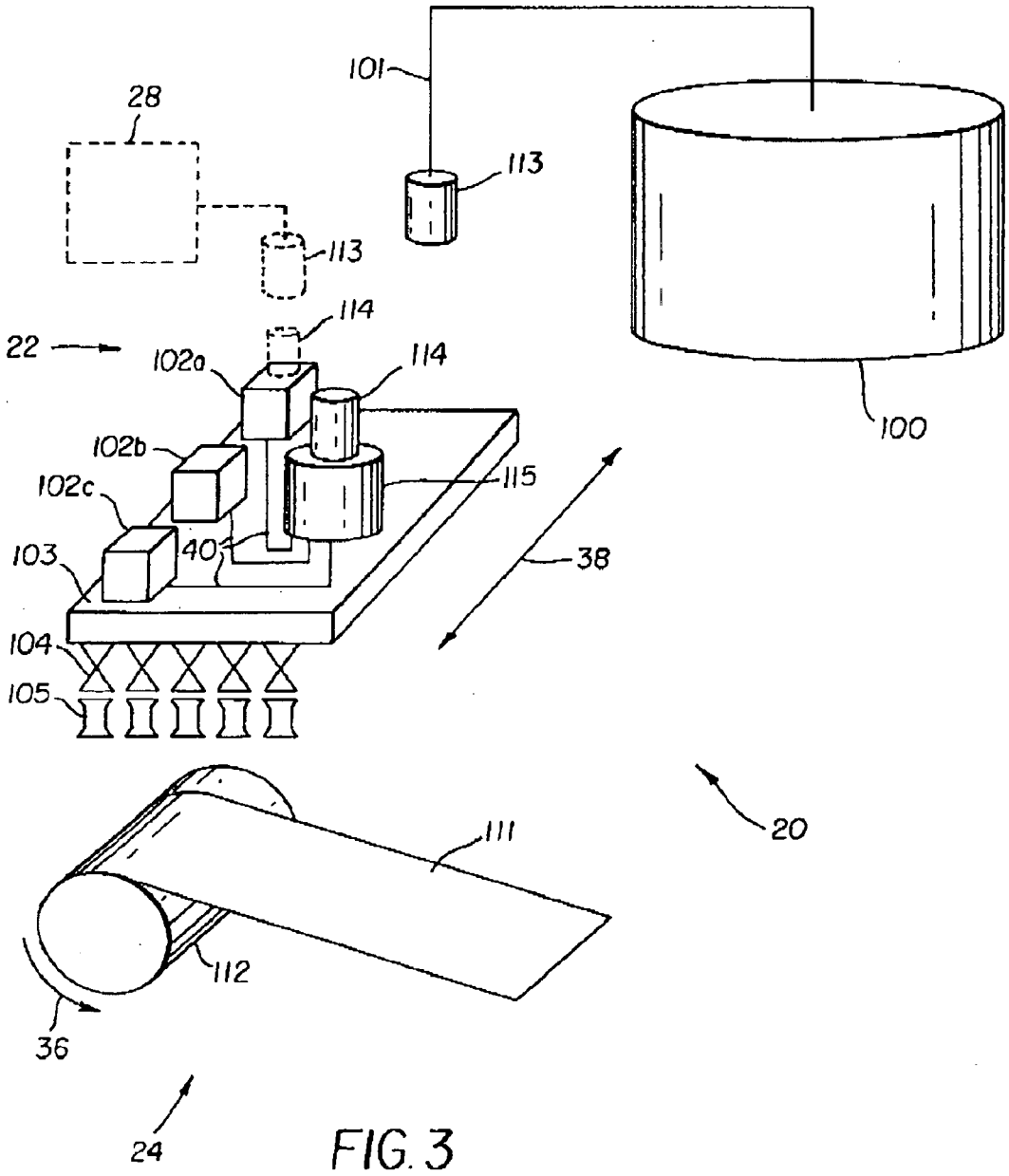

Referring to FIG. 3, a third embodiment is shown. In this embodiment, the marking material delivery system 22 includes a supercritical fluid source 115 positioned on the printhead 103. The supercritical fluid source 115 is in fluid communication with the formulation reservoir(s) 102*a*, 102*b*, 102*c* through delivery path(s) 40 located on or in the printhead 103. The formulation reservoir(s) 102*a*, 102*b*, 102*c* are connected in fluid communication with the discharge device(s) 105 through delivery path(s) 26 positioned on or in the printhead 103.

The supercritical fluid source 100 is connected to a docking station 113 which mates with a recharging port 114 of the supercritical fluid source 115 located on the printhead 103. This allows the supercritical fluid contained in the supercritical fluid source 115 located on the printhead 103 to be replenished as is required during a printing operation. Recharging can occur in a variety of situations, for example, recharging can occur when a predetermined remaining pressure or weight of the supercritical fluid source 115 is detected; after a known volume of supercritical fluid has been discharged; at any convenient time during the printing process; etc. The docking station 113 is supplied with supercritical fluid from a supercritical fluid source 100 through rigid tubing 101. However, flexible tubing 110 can be used.

The source or marking material 28 can also be connected to a docking station 113 which mates with a recharging port 114 of the formulation reservoir(s) 102*a*, 102*b*, 102*c* (shown in phantom in FIG. 3). This allows the marking material contained in the formulation reservoir(s) 102*a*, 102*b*, 102*c* located on the printhead 103 to be replenished as is required during a printing operation. Depending on the number of formulation reservoir(s) 102*a*, 102*b*, 102*c*, multiple docking stations 113 and recharging ports 114 can be included.

Figure 4:
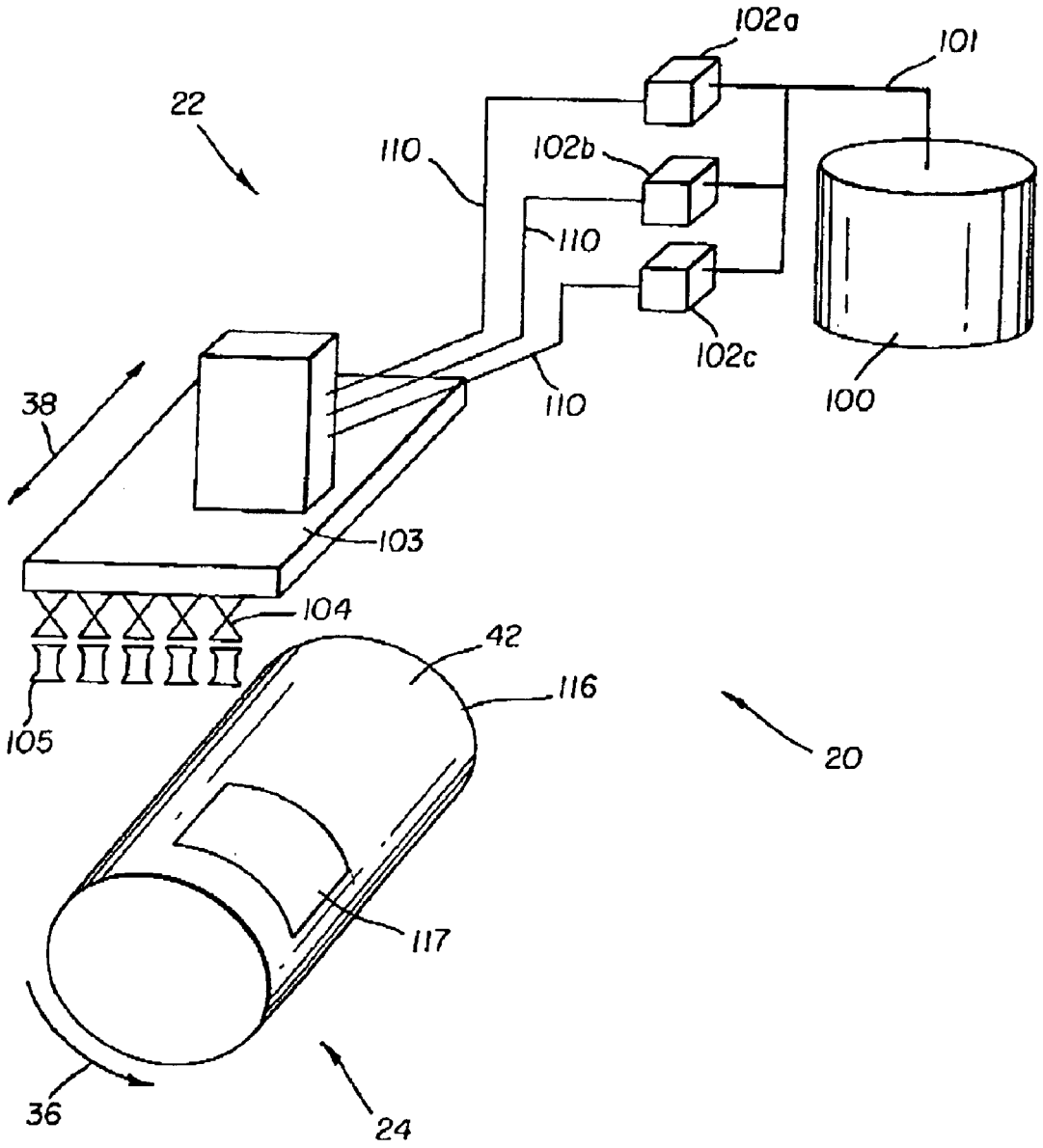

Referring to FIG. 4, the receiver retaining device 24 includes a spinning drum 113. Typically, the spinning drum 116 provides faster translations than are possible with the feed roller 112 (shown in FIG. 2) which increases the overall printing speed of the printing apparatus 20. The supercritical fluid source 100, rigid tubing 101, formulation reservoir(s) 102*a*, 102*b*, 102*c*, flexible tubing 110, printhead 103, actuating mechanisms 104 and discharge devices 105 operate as described with reference to FIG. 2.

In operation, the spinning drum 116 typically completes at least on revolution in the first direction 36 prior to translating the printhead 103 in the second direction 38. As such, the printhead 103 does not have to translate back and forth along the second direction 38 during the printing operation. In this embodiment, it is possible to maintain a high rate of relative motion between the flexible receiver 117 and the printhead 103 because the printhead 103 typically makes a single pass along second direction 38 during printing.

Figure 5:
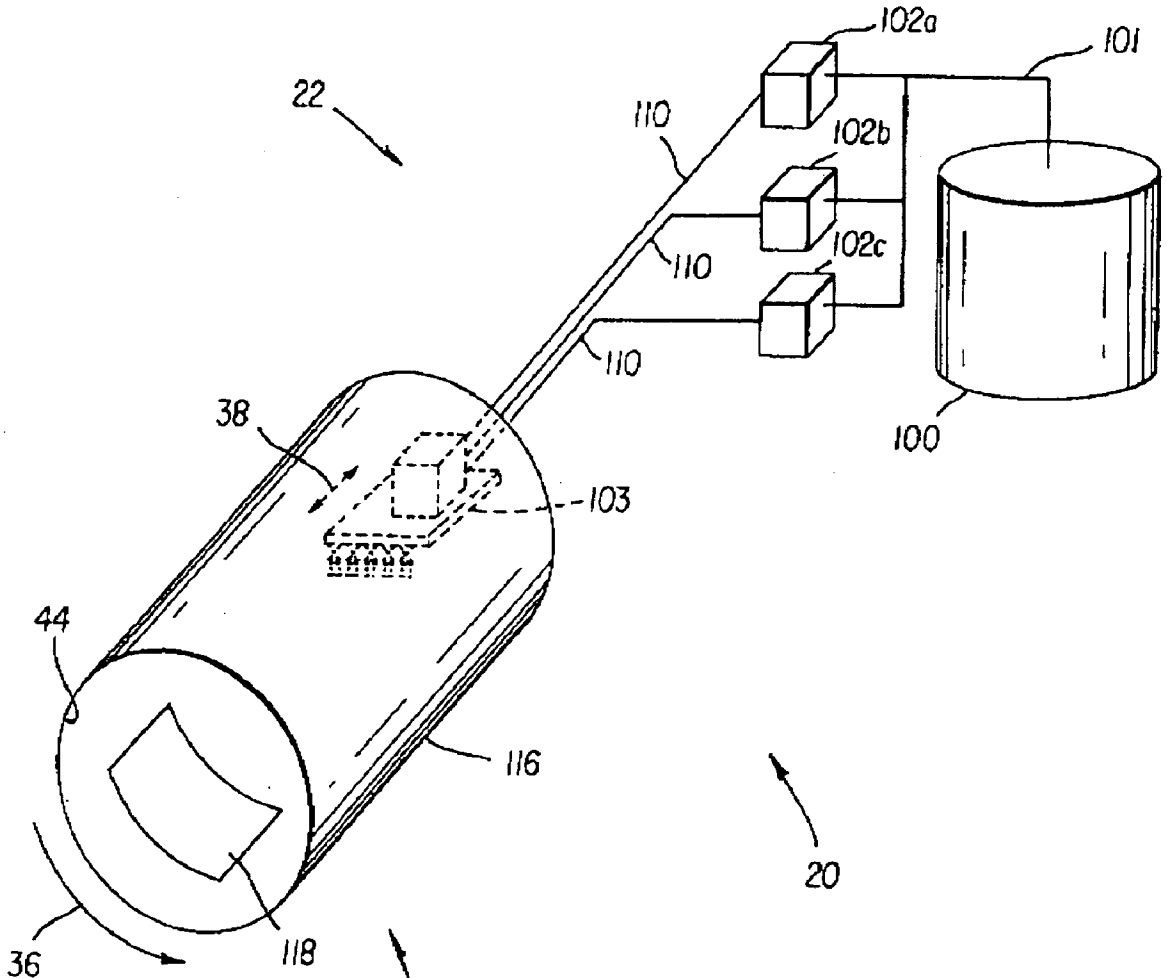
Figure 6A:
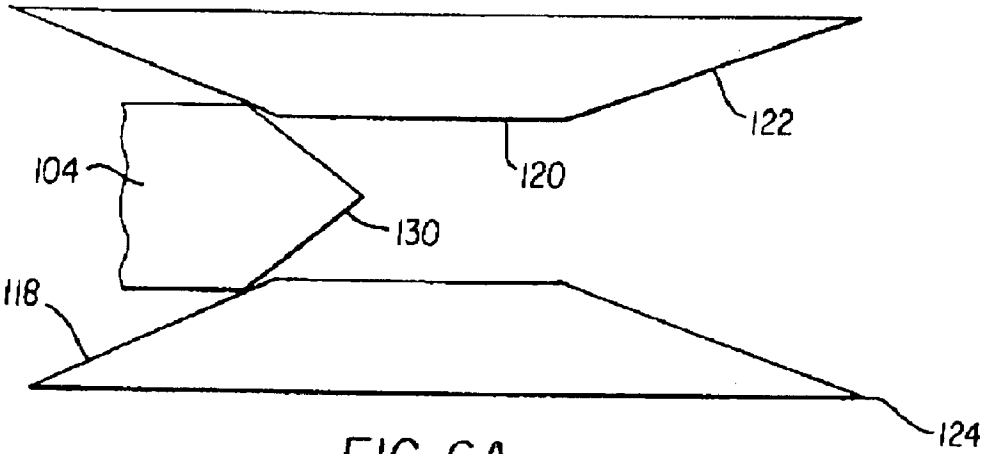
FIGS. 6A–7B are schematic views of a discharge device and an actuating mechanism made in accordance with the present invention.
Figure 6B:
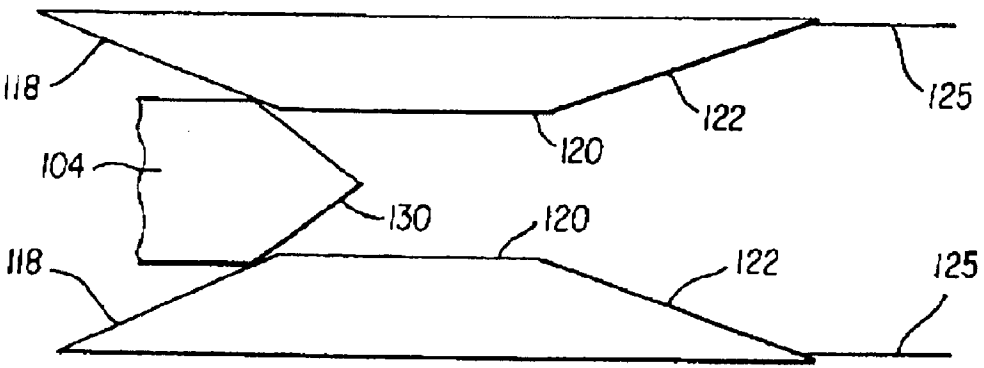
Figure 7A:
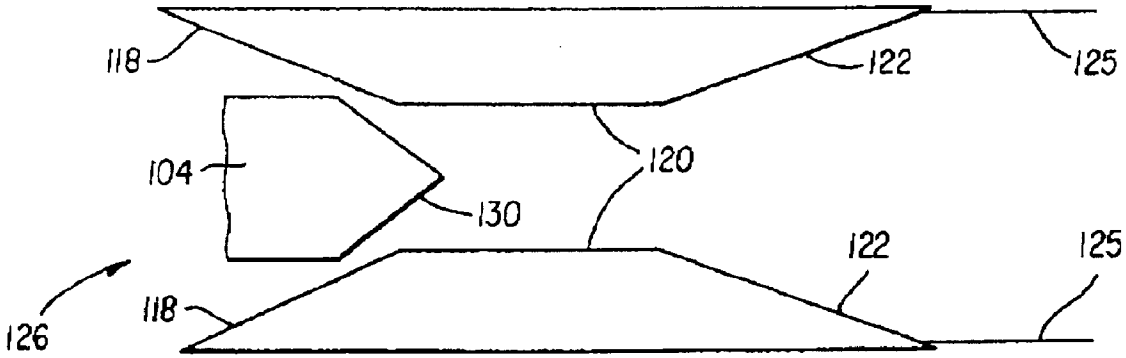
Figure 7B:
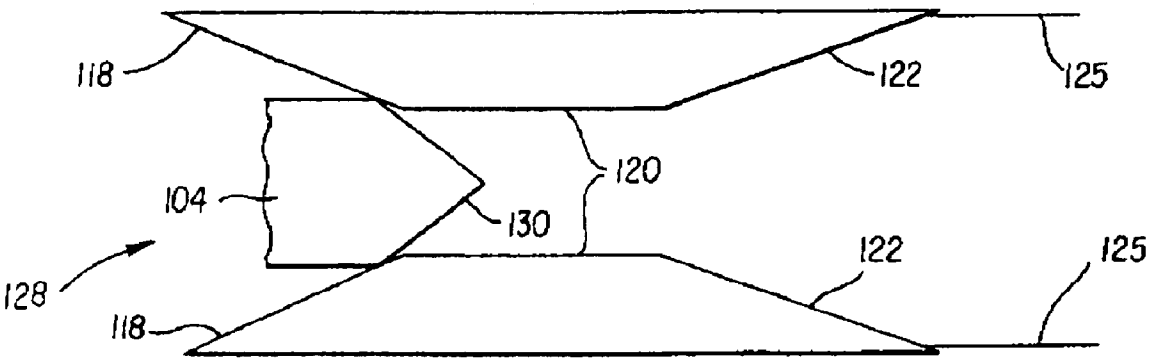

In FIG. 4, the receiver 117 is positioned on an exterior surface 42 of the drum 116. Referring to FIG. 5, a receiver 118 is positioned on an interior surface 44 of the drum 116. In this embodiment, the printhead 103 translates slowly along the length of the interior of the drum 116 in the second direction 38.

Alternatively, as the movement of the printhead 103 in the second direction 38 is typically slow (as compared to the speed of rotation of the drum 116), the marking material delivery system 22 described with reference to FIG. 3 can be substituted for the marking material delivery system 22 described with reference to FIGS. 4 and 5. Additionally, the drum 116 can also be translated in the second direction 38 while the printhead 103 remains stationary for some applications, Again, this is because of the typically slow movement in the second direction as compared to the speed of rotation of the drum 116. In this application, the marking material delivery system described with reference to FIG. 1 can be substituted for the marking material delivery system 22 described with reference to FIGS. 4 and 5.

These embodiments are described as examples of possible ways of achieving desired relative movements of the printhead 103 and the receiver 106, 117, 118. However, it is recognized that there are other possible ways to achieve relative motion of the print head 103 and the receiver 106, 117, 118.

Referring to FIGS. 6A–7B, the discharge device 105 of the print head 103 includes a first variable area section 118 followed by a first constant area section 120. A second variable area section 122 diverges from constant area section 120 to an end 124 of discharge device 105. The first variable area section 118 converges to the first constant area section 120. The first constant area section 118 has a diameter substantially equivalent to the exit diameter of the first variable area section 120. Alternatively, discharge device 105 can also include a second constant area section 125 positioned after the variable area section 122. Second constant area section 125 has a diameter substantially equivalent to the exit diameter of the variable area section 122. Discharge devices 105 of this type are commercially available from Moog, East Aurora, N.Y.; Vindum Engineering Inc., San Ramon, Calif., etc.

The actuating mechanism 104 is positioned within discharge device 105 and moveable between an open position 126 and a closed position 128 and has a sealing mechanism 130. In closed position 128, the sealing mechanism 130 in the actuating mechanism 104 contacts constant area section 120 preventing the discharge of the thermodynamically stable mixture of supercritical fluid and marking material. In open position 126, the thermodynamically stable mixture of supercritical fluid and marking material is permitted to exit discharge device 105.

The actuating mechanism 104 can also be positioned in various partially opened positions depending on the particular printing application, the amount of thermodynamically stable mixture of fluid and marking material desired, etc. Alternatively, actuating mechanism 104 can be a solenoid valve having an open and closed position. When actuating mechanism 104 is a solenoid valve, it is preferable to also include an additional position controllable actuating mechanism to control the mass flow rate of the thermodynamically stable mixture of fluid and marking material.

In a preferred embodiment of discharge device 105, the diameter of the first constant area section 120 of the discharge device 105 ranges from about 20 microns to about 2,000 microns. In a more preferred embodiment, the diameter of the first constant area section 120 of the discharge device 105 ranges from about 10 microns to about 20 microns. Additionally, first constant area section 120 has a predetermined length from about 0.1 to about 10 times the diameter of first constant area section 120 depending on the printing application. Sealing mechanism 130 can be conical in shape, disk shaped, etc.

Referring back to FIGS. 1–5, the marking material delivery system 22 takes a chosen solvent and/or predetermined marking materials to a compressed liquid and/or supercritical fluid state, makes a solution and/or dispersion of a predetermined marking material or combination of marking materials in the chosen compressed liquid and/or supercritical fluid, and delivers the marking materials as a collimated and/or focused beam onto a receiver 106 in a controlled manner. In a preferred printing application, the predetermined marking materials include cyan, yellow and magenta dyes or pigments.

In this context, the chosen materials taken to a compressed liquid and/or supercritical fluid state are gases at ambient pressure and temperature. Ambient conditions are preferably defined as temperature in the range from −100 to +100° C., and pressure in the range from $1\times10^{-8}$–1000 atm for this application.

A supercritical fluid carrier, contained in the supercritical fluid source 100, is any material that dissolves/solubilizes/disperses a marking material. The supercritical fluid source 100 delivers the supercritical fluid carrier at predetermined conditions of pressure, temperature, and flow rate as a supercritical fluid, or a compressed liquid. Materials that are above their critical point, as defined by a critical temperature and a critical pressure, are known as supercritical fluids. The critical temperature and critical pressure typically define a thermodynamic state in which a fluid or a material becomes supercritical and exhibits gas like and liquid like properties. Materials that are at sufficiently high temperatures and pressures below their critical point are known as compressed liquids. Materials in their supercritical fluid and/or compressed liquid state that exist as gases at ambient conditions find application here because of their unique ability to solubilize and/or disperse marking materials of interest when in their compressed liquid or supercritical state.

Fluid carriers include, but are not limited to, carbon dioxide, nitrous oxide, ammonia, xenon, ethane, ethylene, propane, propylene, butane, isobutane, chlorotrifluoromethane, monofluoromethane, sulphur hexafluoride and mixtures thereof. In a preferred embodiment, carbon dioxide is generally preferred in many applications, due its characteristics, such as low cost, wide availability, etc.

The formulation reservoir(s) 102*a*, 102*b*, 102*c* in FIG. 1 is utilized to dissolve and/or disperse predetermined marking materials in compressed liquids or supercritical fluids with or without dispersants and/or surfactants, at desired formulation conditions of temperature, pressure, volume, and concentration. The combination of marking materials and compressed liquid/supercritical fluid is typically referred to as a mixture, formulation, etc.

The formulation reservoir(s) 102*a*, 102*b*, 102*c* in FIG. 1 can be made out of any suitable materials that can safely operate at the formulation conditions. An operating range from 0.001 atmosphere ($1.013\times10^{2}$ Pa) to 1000 atmospheres ($1.013\times10^{8}$ Pa) in pressure and from −25 degrees Centigrade to 1000 degrees Centigrade is generally preferred. Typically, the preferred materials include various grades of high pressure stainless steel. However, it is possible to use other materials if the specific deposition or etching application dictates less extreme conditions of temperature and/or pressure.

The formulation reservoir(s) 102*a*, 102*b*, 102*c* in FIG. 1 should be adequately controlled with respect to the operating conditions (pressure, temperature, and volume). The solubility/dispersibility of marking materials depends upon the conditions within the formulation reservoir(s) 102*a*, 102*b*, 102*c*. As such, small changes in the operating conditions within the formulation reservoir(s) 102*a*, 102*b*, 102*c* can have undesired effects on marking material solubility/dispensability.

Additionally, any suitable surfactant and/or dispersant material that is capable of solubilizing/dispersing the marking materials in the compressed liquid/supercritical fluid for a specific application can be incorporated into the mixture of marking material and compressed liquid/supercritical fluid. Such materials include, but are not limited to, fluorinated polymers such as perfluoropolyether, siloxane compounds, etc.

The marking materials can be controllably introduced into the formulation reservoir(s) 102*a*, 102*b*, 102*c*. The compressed liquid/supercritical fluid is also controllably introduced into the formulation reservoir(s) 102*a*, 102*b*, 102*c*. The contents of the formulation reservoir(s) 102*a*, 102*b*, 102*c* are suitably mixed, using a mixing device to ensure intimate contact between the predetermined imaging marking materials and compressed liquid/supercritical fluid. As the mixing process proceeds, marking materials are dissolved or dispersed within the compressed liquid/supercritical fluid. The process of dissolution/dispersion, including the amount of marking materials and the rate at which the mixing proceeds, depends upon the marking materials itself, the particle size and particle size distribution of the marking material (if the marking material is a solid), the compressed liquid/supercritical fluid used, the temperature, and the pressure within the formulation reservoir(s) 102*a*, 102*b*, 102*c*. When the mixing process is complete, the mixture or formulation of marking materials and compressed liquid/supercritical fluid is thermodynamically stable/metastable, in that the marking materials are dissolved or dispersed within the compressed liquid/supercritical fluid in such a fashion as to be indefinitely contained in the same state as long as the temperature and pressure within the formulation chamber are maintained constant. This state is distinguished from other physical mixtures in that there is no settling, precipitation, and/or agglomeration of marking material particles within the formulation chamber, unless the thermodynamic conditions of temperature and pressure within the reservoir are changed. As such, the marking material and compressed liquid/supercritical fluid mixtures or formulations of the present invention are said to be thermodynamically stable/metastable. This thermodynamically stable/metastable mixture or formulation is controllably released from the formulation reservoir(s) 102*a*, 102*b*, 102*c* through the discharge device 105 and actuating mechanism 104.

During the discharge process, the marking materials are precipitated from the compressed liquid/supercritical fluid as the temperature and/or pressure conditions change. The precipitated marking materials are preferably directed towards a receiver 106 by the discharge device 105 through the actuating mechanism 104 as a focussed and/or collimated beam. The invention can also be practiced with a non-collimated or divergent beam provided that the diameter of first constant area section 120 and printhead 103 to receiver 106 distance are appropriately small. For example, in a discharge device 105 having a 10 um first constant area section 120 diameter, the beam can be allowed to diverge before impinging receiver 106 in order to produce a printed dot size of about 60 um (a common printed dot size for many printing applications). Discharge device 105 diameters of these sizes can be created with modem manufacturing techniques such as focused ion beam machining, MEMS processes, etc.

The particle size of the marking materials deposited on the receiver 105 is typically in the range from 100 nanometers to 1000 nanometers. The particle size distribution may be controlled to be uniform by controlling the rate of change of temperature and/or pressure in the discharge device 105, the location of the receiver 106 relative to the discharge device 105, and the ambient conditions outside of the discharge device 105.

The print head 103 is also designed to appropriately change the temperature and pressure of the formulation to permit a controlled precipitation and/or aggregation of the marking materials. As the pressure is typically stepped down in stages, the formulation fluid flow is self-energized. Subsequent changes to the formulation conditions (a change in pressure, a change in temperature, etc.) result in the precipitation and/or aggregation of the marking material, coupled with an evaporation of the supercritical fluid and/or compressed liquid. The resulting precipitated and/or aggregated marking material deposits on the receiver 106 in a precise and accurate fashion. Evaporation of the supercritical fluid and/or compressed liquid can occur in a region located outside of the discharge device 105. Alternatively, evaporation of the supercritical fluid and/or compressed liquid can begin within the discharge device 105 and continue in the region located outside the discharge device 105. Alternatively, evaporation can occur within the discharge device 105.

A beam (stream, etc.) of the marking material and the supercritical fluid and/or compressed liquid is formed as the formulation moves through the discharge device 105. When the size of the precipitated and/or aggregated marking materials is substantially equal to an exit diameter of the discharge device 105, the precipitated and/or aggregated marking materials have been collimated by the discharge device 105. When the sizes of the precipitated and/or aggregated marking materials are less than the exit diameter of the discharge device 105, the precipitated and/or aggregated marking materials have been focused by the discharge device 105.

The receiver 106 is positioned along the path such that the precipitated and/or aggregated predetermined marking materials are deposited on the receiver 106. The distance of the receiver 106 from the discharge device 105 is chosen such that the supercritical fluid and/or compressed liquid evaporates from the liquid and/or supercritical phase to the gas phase prior to reaching the receiver 106. Hence, there is no need for a subsequent receiver drying processes. Alternatively, the receiver 106 can be electrically or electrostatically charged, such that the location of the marking material in the receiver 106 can be controlled.

It is also desirable to control the velocity with which individual particles of the marking material are ejected from the discharge device 105. As there is a sizable pressure drop from within the printhead 103 to the operating environment, the pressure differential converts the potential energy of the printhead 103 into kinetic energy that propels the marking material particles onto the receiver 106. The velocity of these particles can be controlled by suitable discharge device 105 with an actuating mechanism 104. Discharge device 105 design and location relative to the receiver 106 also determine the pattern of marking material deposition.

The temperature of the discharge device 105 can also be controlled. Discharge device temperature control may be controlled, as required, by specific applications to ensure that the opening in the discharge device 105 maintains the desired fluid flow characteristics.

The receiver 106 can be any solid material, including an organic, an inorganic, a metallo-organic, a metallic, an alloy, a ceramic, a synthetic and/or natural polymeric, a gel, a glass, or a composite material. The receiver 106 can be porous or non-porous. Additionally, the receiver 106 can have more than one layer. The receiver 106 can be a sheet of predetermined size. Alternately, the receiver 106 can be a continuous web.

Referring back to FIGS. 1–5, in addition to multiple color printing, additional marking material can be dispensed through printhead 103 in order to improve color gamut, provide protective overcoats, etc. When additional marking materials are included check valves and printhead design help to reduce marking material contamination.

Figure 8:
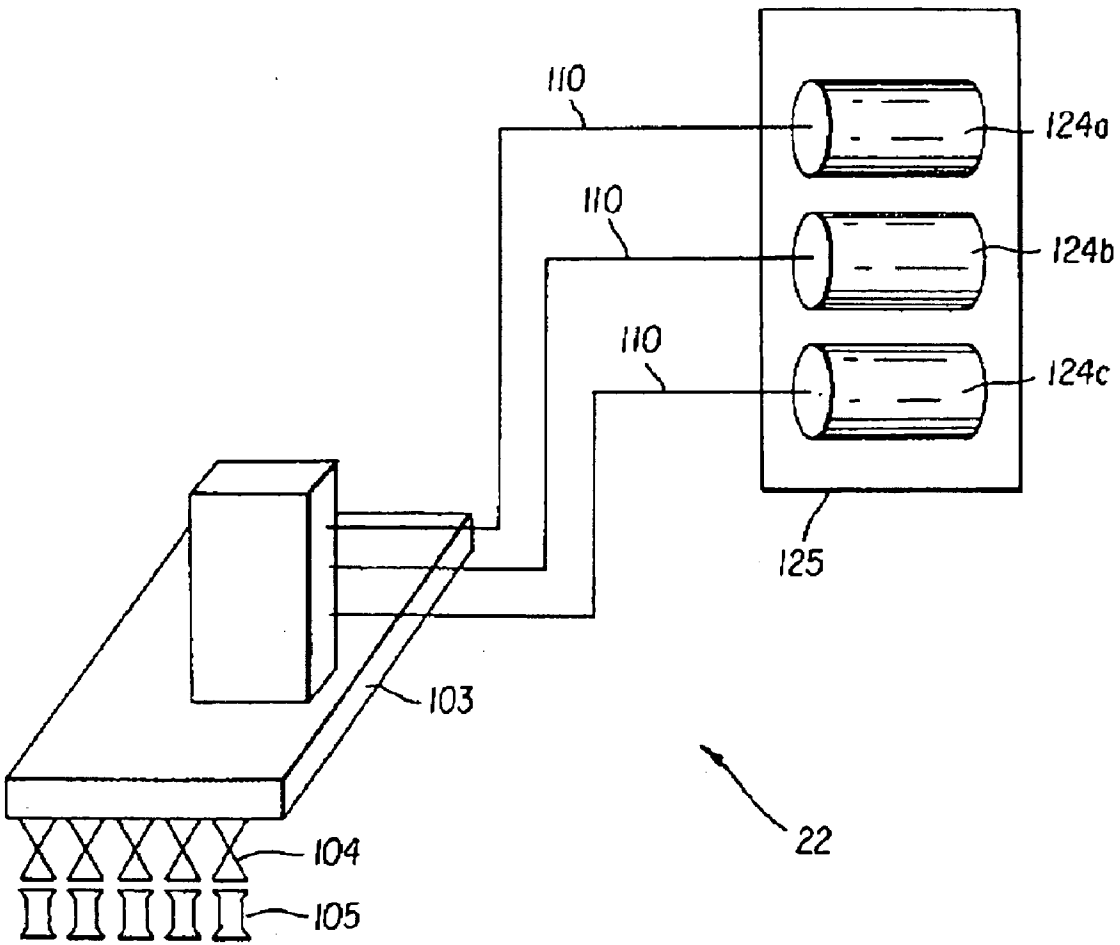
FIGS. 8–9B are schematic views of alternative embodiments made in accordance with the present invention.

Referring to FIG. 8, a premixed tank(s) 124*a*, 124*b*, 124*c*, containing premixed predetermined marking materials and the supercritical fluid and/or compressed liquid are connected in fluid communication through tubing 110 to printhead 103. The premixed tank(s) 124*a*, 124*b*, 124*c* can be supplied and replaced either as a set 125, or independently in applications where the contents of one tank are likely to be consumed more quickly than the contents of other tanks. The size of the premixed tank(s) 124*a*, 124*b*, 124*c*, can be varied depending on anticipated usage of the contents. The premixed tank(s) 124*a*, 124*b*, 124*c* are connected to the discharge devices 105 through delivery paths 26. When multiple color printing is desired, the discharge devices 105 and delivery paths 26 are dedicated to a particular premixed tank(s) 124*a*, 124*b*, 124*c*.

Figure 9A:
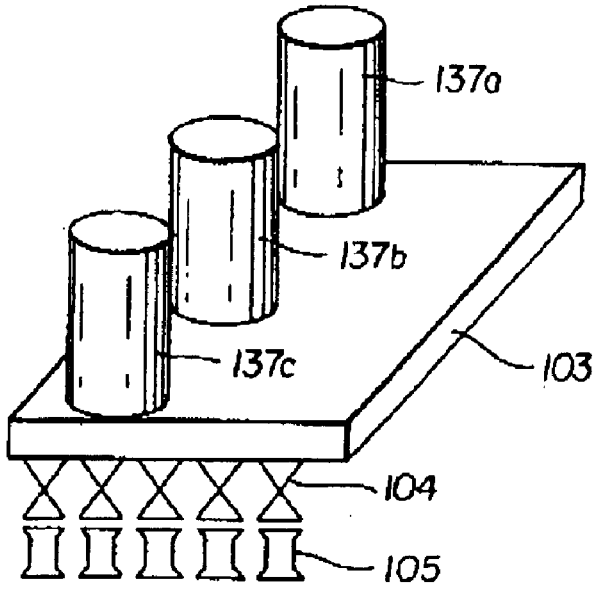
Figure 9B:
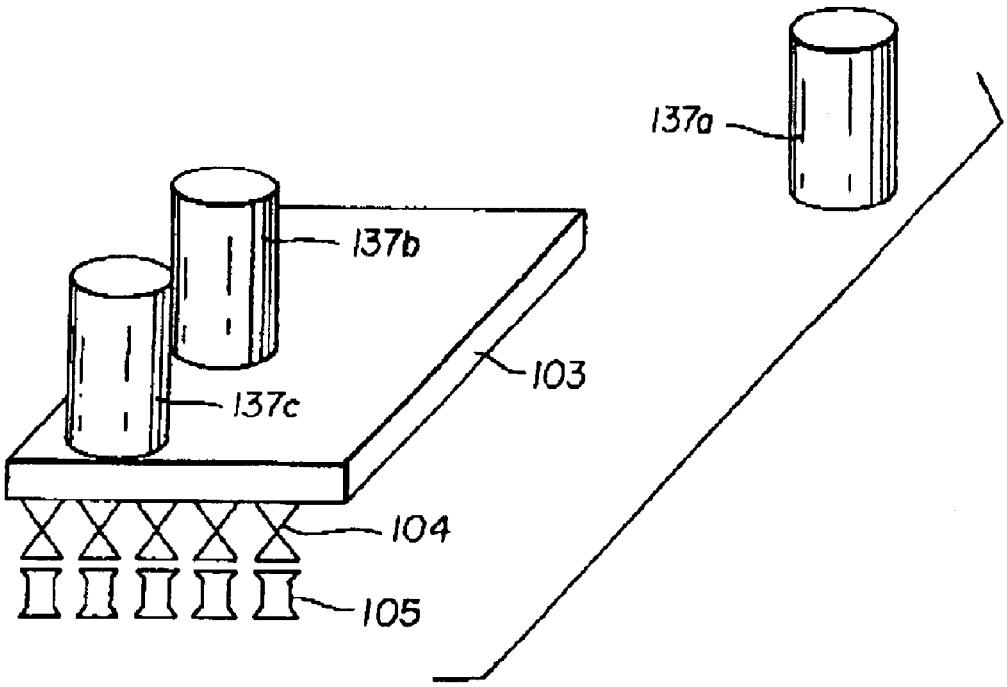

Referring to FIGS. 9A and 9B, another embodiment describing premixed canisters containing predetermined marking materials is shown. Premixed canister(s) 137*a*, 137*b*, 137*c* is positioned on the printhead 103. When replacement is necessary, premixed canister 137*a*, 137*b*, 137*c* can be removed from the printhead 103 and replaced with another premixed canister(s) 137*a*, 137*b*, 137*c*.

Figure 10:
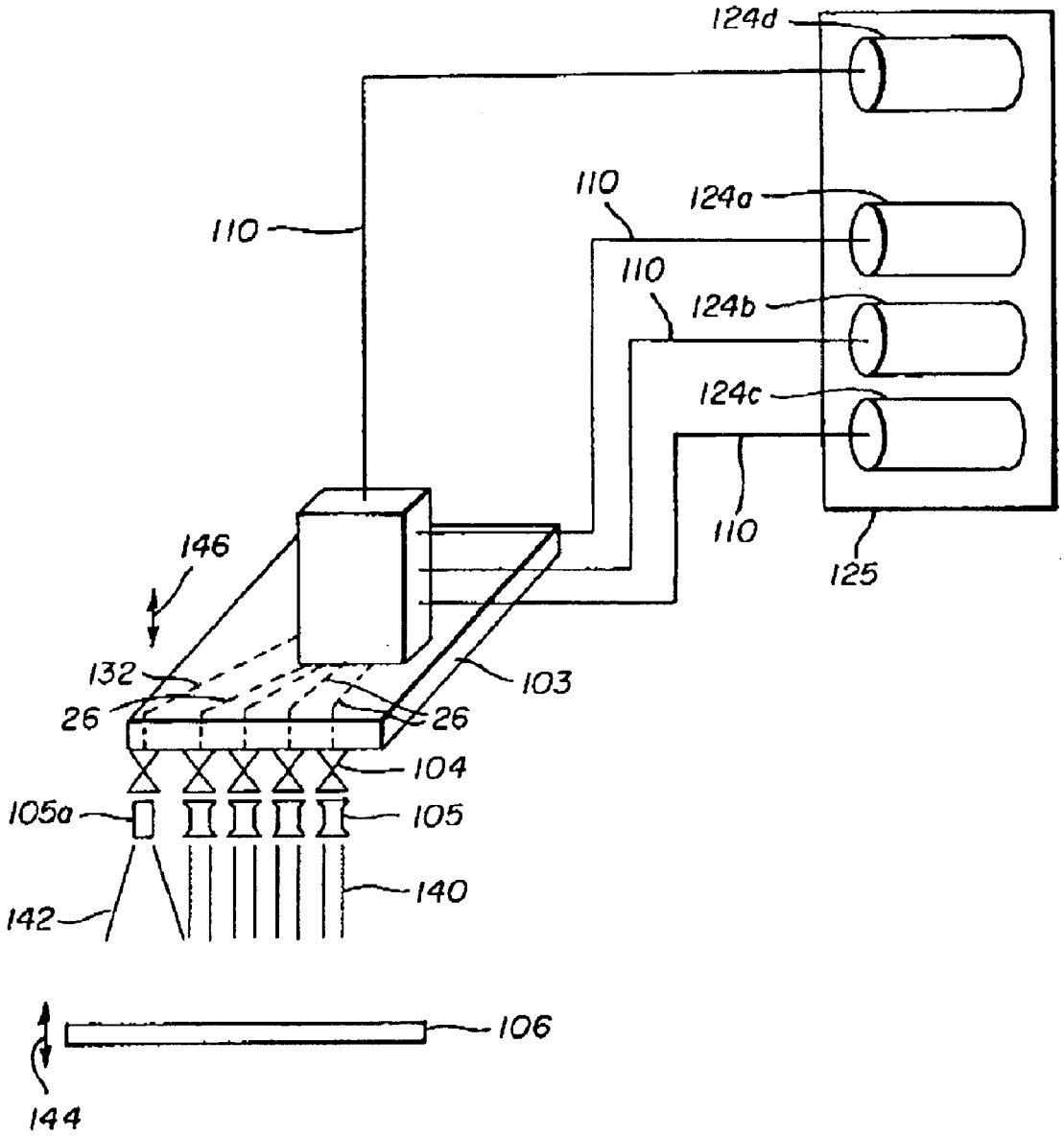
FIGS. 10–11D are schematic views alternative embodiments made in accordance with the present invention.

Referring to FIG. 10, premixed tank(s) 124*a*, 124*b*, 124*c*, containing premixed predetermined marking materials and the supercritical fluid and/or compressed liquid are connected in fluid communication through tubing 110 to printhead 103. The premixed tank(s) 124*a*, 124*b*, 124*c* can be supplied and replaced either as a set 125, or independently in applications where the contents of one tank are likely to be consumed more quickly than the contents of other tanks. The size of the premixed tank(s) 124*a*, 124*b*, 124*c*, can be varied depending on anticipated usage of the contents. The premixed tank(s) 124*a*, 124*b*, 124*c* are connected to the discharge devices 105 through delivery paths 26. When multiple color printing is desired, the discharge devices 105 and delivery paths 26 are dedicated to a particular premixed tank(s) 124*a*, 124*b*, 124*c*. Discharge devices 105 can be, for example, of the type described with reference to FIGS. 6A–7B above which can produce a collimated beam 140 of marking material An additional premixed tank 124*d*, containing a premixed predetermined marking material and the supercritical fluid and/or compressed liquid, is connected in fluid communication through tubing 110 and a delivery path 132 to a discharge device 105*a*. Discharge device 105*a* is shaped to produce a diverging beam 142 of marking material. Discharge device 105*a* can be, for example, a capillary tube having a diameter 10 to 1000 microns. Typically, diverging beam 142 can cover a larger area of receiver 106 which makes discharge device suitable for delivering an overcoat and/or a precoat marking material.

For example, an image or image with text can be printed, as described above, by actuating discharge devices 105. Then, discharge devices 105*a* can be subsequently actuated to produce an overcoat layer on the receiver 106. As the marking material delivered by discharge devices 105 is free from solvent, significant drying time is not required before delivering the overcoat layer through discharge device 105*a*. The overcoat marking material can include any suitable organic and/or inorganic material.

Additionally, the location of receiver 106 can be adjusted (shown using arrow 144) relative to the outlet of the discharge device 105 or 105*a* in order to increase or decrease the area of coverage or the amount of marking material delivered to a particular location of receiver 106. This can be accomplished using translation stages, as described above. Alternatively, the position of the printhead 103 can be adjusted (shown using arrow 146) to increase or decrease the area of coverage.

Alternatively, a diverging beam of marking material can be achieved by varying the mass flow rate of delivery through discharge device 105. For example, the mass flow rate can be increased to create a divergent beam of marking material and decreased to create a collimated beam of marking material.

The printhead configuration shown with reference to FIG. 10 can be incorporated into other types of printing systems, for example, those systems described with reference to FIGS. 1–9.

Referring to FIGS. 11A–11D, it has been determined, as described below with reference to Tables 1 and 2, that a beam of marking material 148 delivered to receiver 106 from discharge device 105 demonstrates collimated, diverging, and converging characteristics. As such, receiver 106 can be positioned at predetermined locations relative to printhead 103 through out the printing process depending the type of marking material being delivered to receiver 106.

For example, when an image and/or text is being printed, receiver 106 is positioned relative to printhead such that a collimated beam (FIG. 11B) or a diverging beam (FIG. 11C) of marking material is delivered to receiver 106 from premixed tank(s) 124*a*, 124*b*, 124*c*, containing premixed predetermined marking materials and the supercritical fluid and/or compressed liquid. When printing is complete, the position of receiver 106 is adjusted (FIG. 11D) and an overcoat marking material is delivered to receiver 106 from premixed tank 124*d*. As the marking material delivered by discharge devices 105 is free from solvent when the marking material contacts receiver 106, little or no drying time is required before delivering the overcoat layer. Typically, a switching mechanism 150 (for example, a valve, etc.) is actuated prior to delivering the overcoat material. Alternatively, predetermined discharge devices 105 can be dedicated to delivering overcoat marking material or marking material. Adjustment of receiver 106 can be accomplished using a moveable receiver retaining device 152, for example, an XYZ translator, a mechanical arm, etc. Alternatively, the position of the printhead 103 relative to the receiver 106 can be adjusted.

Figure 11A:
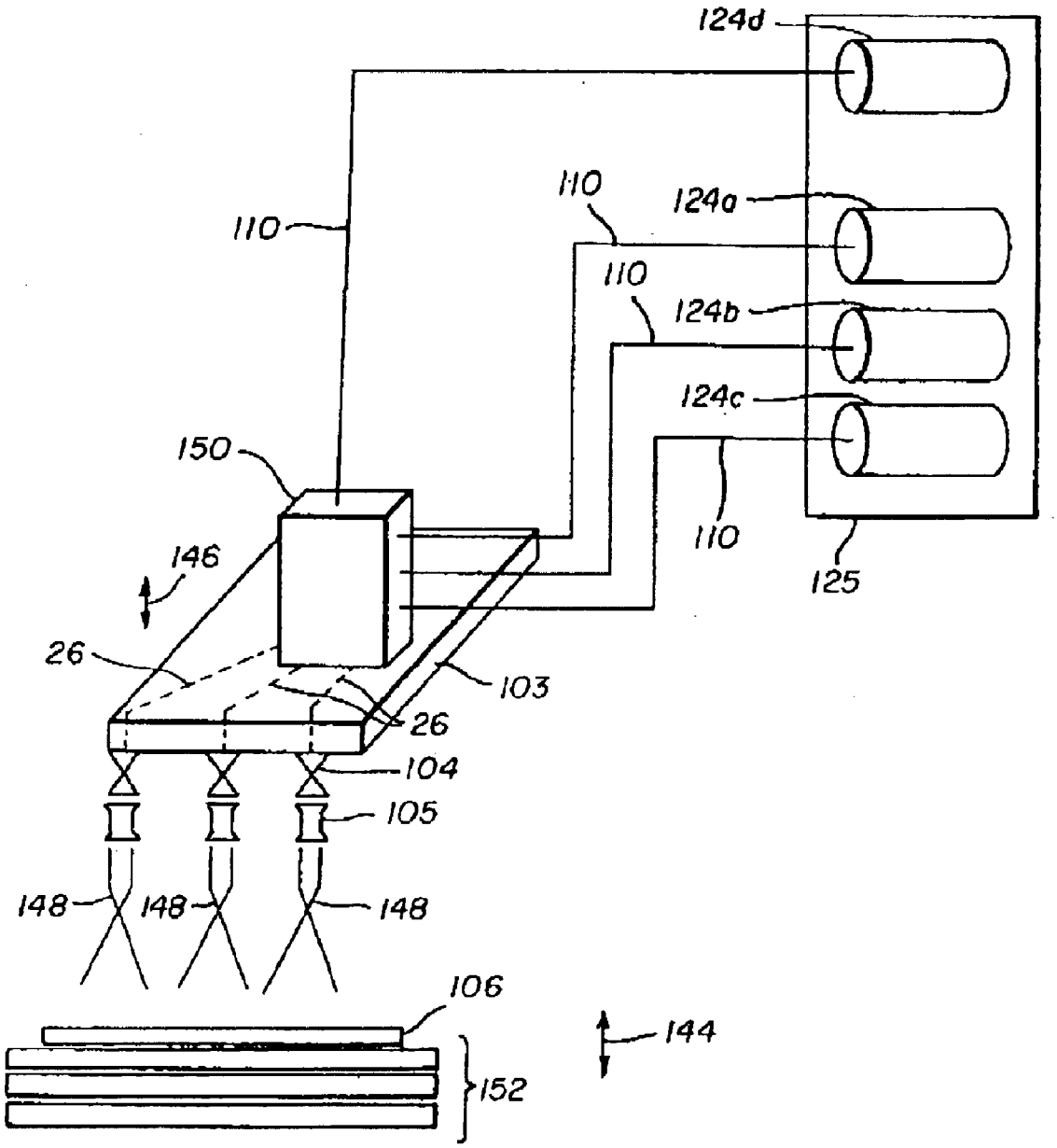
Figure 11B:
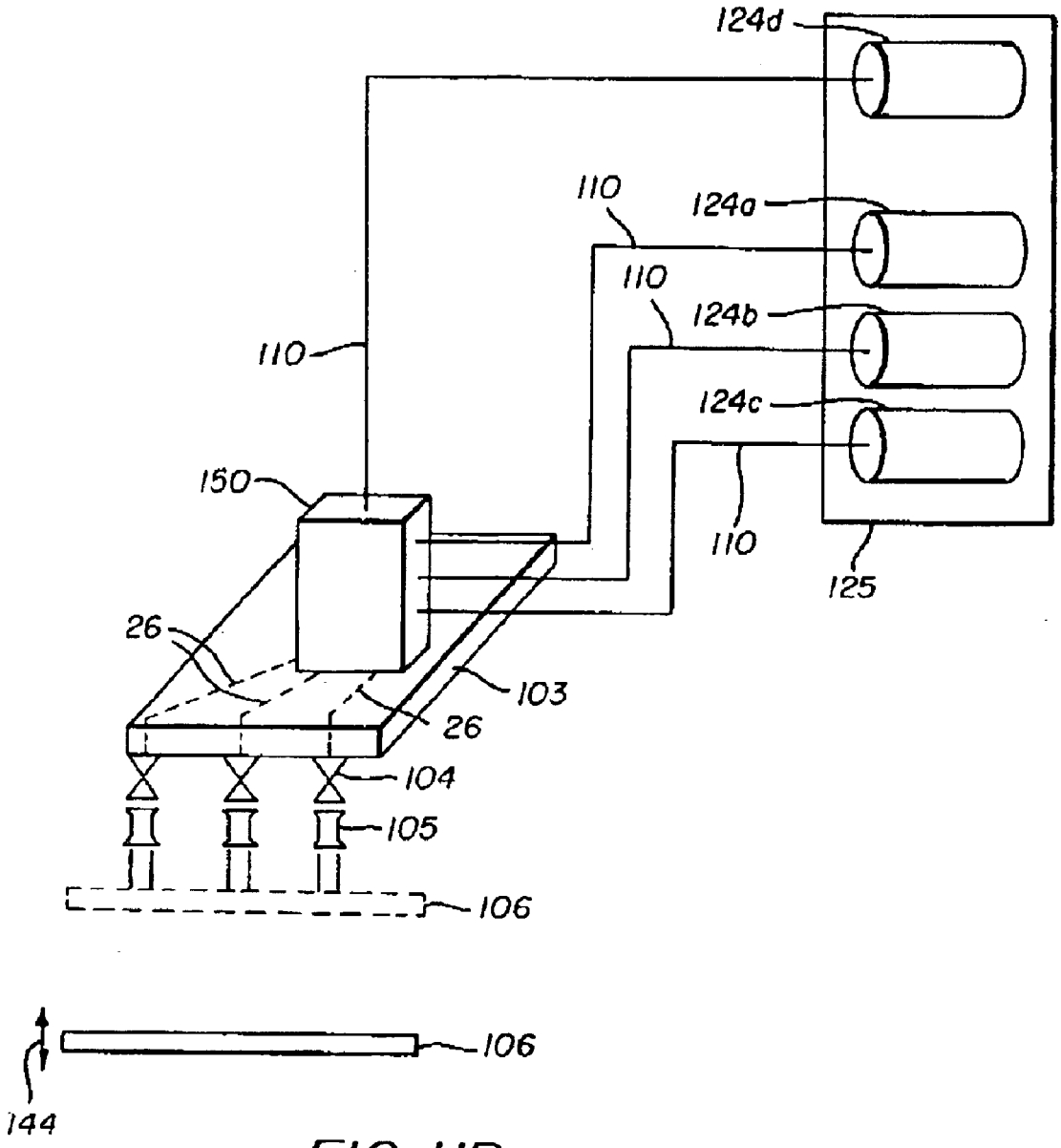
Figure 11C:
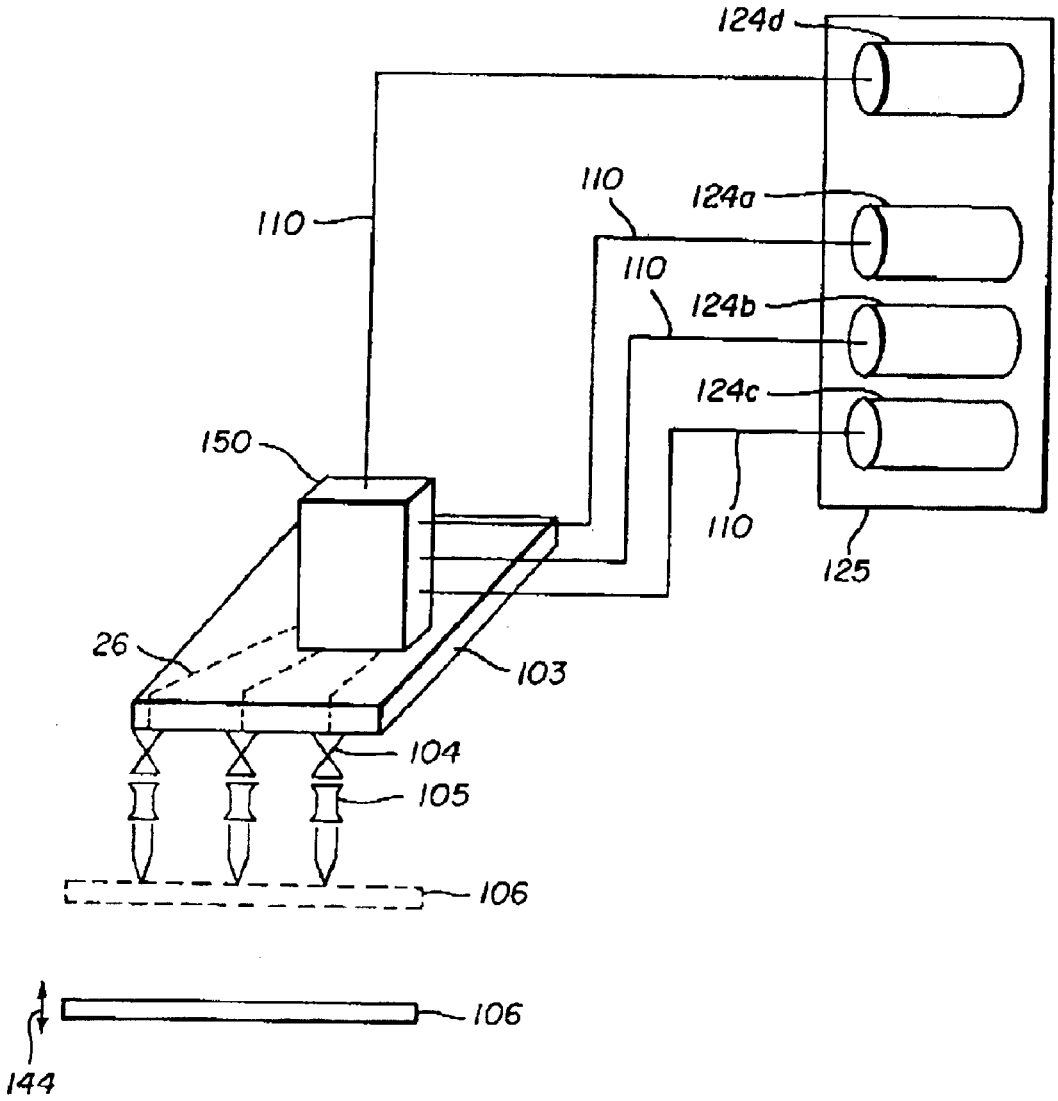
Figure 11D:
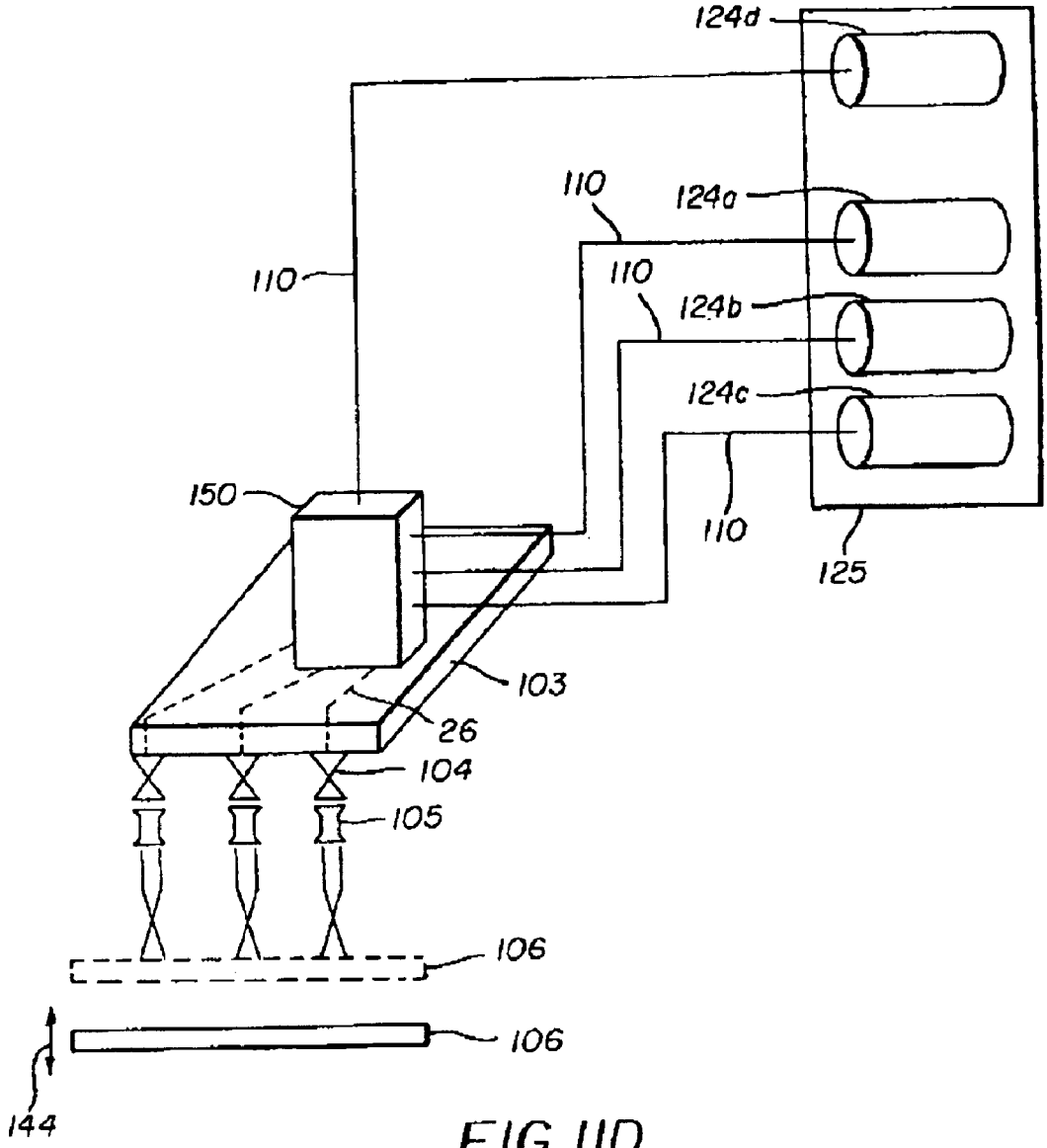

Additionally, when a precoat marking material is to be delivered to receiver 106, the precoat marking material is delivered prior to delivering the marking material. The position of receiver 106 can also be adjusted as needed depending on the printing application. For example, if a collimated or converging beam of overcoat or precoat marking material is desired, the receiver can be positioned as shown in FIGS. 11B and 11C, respectively.

The printhead configuration shown with reference to FIGS. 11A–11D can be incorporated into other types of printing systems, for example, those systems described with reference to FIGS. 1–9.

EXPERIMENTAL RESULTS

Table 1, shown below, describes the results of an experiment where discharge device 105 (throat diameter 300 micrometers) produced a collimated and a convergent beam of marking material. Discharge device 105 was fixed and located at known distances away from a translating receiver 106. The resulting line image on the receiver 106 was measured for width.

TABLE 1

| Nozzle to Substrate distance (micrometers) | Resulting line width (micrometers) |
|---|---|
| 0 | 300 |
| 250 | 100 |
| 500 | 200 |

Table 2, describes the results of a another experiment performed with a discharge device 105*a* (65 micrometer diameter capillary tube) to produce a diverging beam of marking material. Discharge device 105*a* was fixed and located at known distances away from a translating receiver 106. The resulting line image on the receiver 106 was measured for width.

TABLE 2

| Tube to Substrate distance (micrometers) | Resulting line width (micrometers) |
|---|---|
| 0 | 65 |
| 150 | 200 |
| 250 | 300 |
| 350 | 500 |
| 850 | 1000 |

Figure 12:
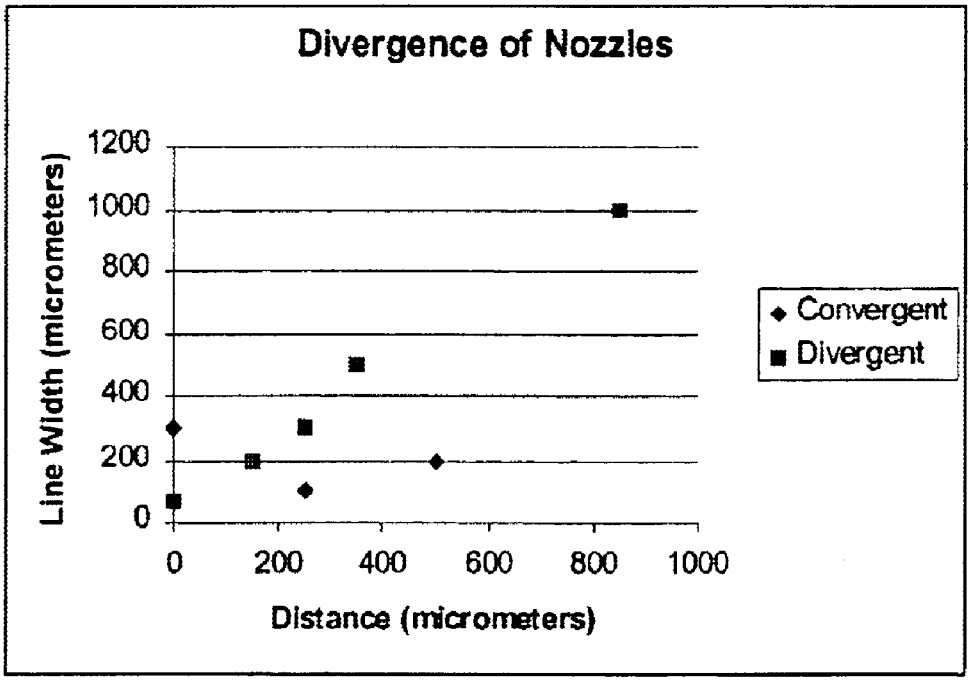
FIG. 12 shows the results of both experiments.

FIG. 12 shows the results of both experiments.

Each of the embodiments described above can be incorporated in a printing network for larger scale printing operations by adding additional printing apparatuses on to a networked supply of supercritical fluid and marking material. The network of printers can be controlled using any suitable controller. Additionally, accumulator tanks can be positioned at various locations within the network in order to maintain pressure levels throughout the network.

The invention has been described in detail with particular reference to certain preferred embodiments thereof, but it will be understood that variations and modifications can be effected within the scope of the invention.

What is claimed is:

1. A printhead for delivering solvent free materials to a receiver comprising:

a first discharge device having an inlet and an outlet, a portion of the first discharge device defining a first delivery path, a portion of the first discharge device being adapted to be connected to a pressurized source of a thermodynamically stable mixture of a fluid and a first marking material at the inlet, the first discharge device being configured to produce a shaped beam of the first marking material, the fluid being in a gaseous state at a location beyond the outlet of the first discharge device;

a first actuating mechanism positioned along the first delivery path, the first actuating mechanism having a first position removed from the first delivery path and a second position in the first delivery path; and a second discharge device having an inlet and an outlet, a portion of the second discharge device defining a second delivery path, a portion of the second discharge device being adapted to be connected to a pressurized source of a thermodynamically stable mixture of a fluid and a second marking material at the inlet, the second discharge device being configured to produce a diverging beam of the second marking material, the fluid being in a gaseous state at a location beyond the outlet of the second discharge device.

2. The printhead according to claim 1, a second actuating mechanism positioned along the second delivery path, the second actuating mechanism having an open position and a closed position.

3. The printhead according to claim 1, wherein the first discharge device includes a variable area section.

4. The printhead according to claim 3, wherein the first discharge device includes a constant area section.

5. The printhead according to claim 1, wherein the first discharge device includes a first variable area section connected to one end of a first constant area section, and a second variable area section connected to another end of the first constant area section.

6. The printhead according to claim 1, wherein the first actuating mechanism includes a solenoid actuating mechanism.

7. The printhead according to claim 6, wherein the solenoid actuating mechanism is actuatable at a plurality of frequencies.

8. The printhead according to claim 1, wherein in the first marking material is an ink.

9. The printhead according to claim 8, wherein in the first marking material includes a dye.

10. The printhead according to claim 8, wherein the first marking material includes a pigment.

11. The printhead according to claim 1, where in the second marking material is an overcoat material.

12. The printhead according to claim 11, wherein the second marking material is an organic material.

13. The printhead according to claim 11, wherein the second marking material is an inorganic material.

14. The printhead according to claim 1, wherein the second marking material is a precoat material.

15. The printing apparatus according to claim 1, wherein the first marking material is solvent free when the fluid is in the gaseous state at the location beyond the outlet of the discharge device.

16. The printing apparatus according to claim 1, wherein the second marking material is solvent free when the fluid is in the gaseous state at the location beyond the outlet of the discharge device.

17. A method of printing comprising:

providing a pressurized source of a thermodynamically stable mixture of a solvent and a marking material;

providing a discharge device having an inlet and an outlet, a portion of the discharge device defining a delivery path, a portion of the discharge device being adapted to be connected to a pressurized source of a thermodynamically stable mixture of a fluid and a marking material at the inlet;

causing the discharge device to produce a first shaped beam of the marking material, the fluid being in a gaseous state at a location beyond the outlet of the discharge device; and causing the discharge device to produce a second shaped beam of the marking material, the fluid being in a gaseous state at a location beyond the outlet of the discharge device.

18. The method according to claim 17, further comprising:

providing a receiver positioned at a first predetermined distance from the outlet of the discharge device.

19. The method according to claim 18, wherein causing the discharge device to produce a shaped beam of the marking material includes delivering the marking material to the receiver positioned at the first predetermined distance to create a printed area on the receiver having a first size.

20. The method according to claim 18, further comprising:

moving the receiver to a second predetermined distance from the outlet of the discharge device.

21. The method according to claim 20, wherein causing the discharge device to produce a shaped beam of the marking material includes delivering the marking material to the receiver positioned at the second predetermined distance to create a printed area on the receiver having a second size.

22. The method according to claim 17, wherein causing the discharge device to produce a first shaped beam of the marking material includes delivering the marking material at a first mass flow rate.

23. The method according to claim 22, wherein causing the discharge device to produce a second shaped beam of the marking material includes delivering the marking material at a second mass flow rate.

24. The method according to claim 23, wherein the second mass flow rate is greater than the first mass flow rate.

25. The method according to claim 17, wherein causing the discharge device to produce a second shaped beam of the marking material includes delivering the marking material at a second mass flow rate.

26. The method according to claim 17, wherein the first shaped beam is a collimated beam.

27. The method according to claim 17, wherein the first shaped beam is a focused beam.

28. The method according to claim 17, wherein the second shaped beam is a diverging beam.

29. The method according to claim 17, wherein causing the discharge device to produce a first shaped beam of the marking material includes providing a first discharge device configured to produce the first shaped beam of the first marking material.

30. The method according to claim 29, wherein causing the discharge device to produce a second shaped beam of the marking material includes providing a second discharge device configured to produce the second shaped beam of the second marking material.

31. The method according to claim 17, wherein the marking material is solvent free when the fluid is in the gaseous state at the location beyond the outlet of the discharge device.

32. A printing apparatus comprising:

a pressurized source of a thermodynamically stable mixture of a fluid and a marking material;

a printhead, portions of the printhead defining a delivery path, the delivery path of the printhead being connected to the pressurized source, the printhead including a discharge device, the discharge device having an outlet, a portion of the discharge device being positioned along the delivery path, the discharge device being shaped to produce a shaped beam of the marking material, the fluid being in a gaseous state at a location beyond the outlet of the discharge device;

an actuating mechanism positioned along the delivery path, the actuating mechanism having an open position at least partially removed from the delivery path; and a receiver retaining device moveably positioned a predetermined distance from the outlet of the discharge device.

33. The printing apparatus according to claim 32, portions of the printhead defining a second delivery path, wherein a second discharge device is positioned along the delivery path, the second discharge device being shaped to produce a second shaped beam of a marking material.

34. The printing apparatus according to claim 32, wherein the marking material is solvent free when the fluid is in the gaseous state at the location beyond the outlet of the discharge device.

* * * * *